United States Patent [19]

Cormier et al.

[11] 4,300,830

[45] Nov. 17, 1981

[54] SHEET REMOVAL ASSEMBLY

[75] Inventors: Raymond G. Cormier, Nashua, N.H.; Jacques Guiguizian, Haverhill, Mass.

[73] Assignee: Nashua Corporation, Nashua, N.H.

[21] Appl. No.: 76,576

[22] Filed: Sep. 18, 1979

[51] Int. Cl.[3] ..... G03G 15/00; B65H 29/56

[52] U.S. Cl. ..... 355/3 SH; 271/308; 271/DIG. 2

[58] Field of Search ..... 271/308, 307, DIG. 2, 271/311, 312, 313; 355/3 SH, 3 TR, 14 SH

[56] References Cited

U.S. PATENT DOCUMENTS

| | | | |
|---|---|---|---|
| 1,148,509 | 8/1915 | Gammeter | 271/311 |
| 3,926,429 | 12/1975 | Satomi et al. | 271/DIG. 2 X |
| 3,936,045 | 2/1976 | Ariyama | 271/311 |
| 3,960,446 | 6/1976 | Ogawa et al. | 271/308 X |
| 4,004,802 | 1/1977 | Brooke | 271/308 |
| 4,179,116 | 12/1979 | Umezawa et al. | 271/DIG. 2 X |

FOREIGN PATENT DOCUMENTS

| | | | |
|---|---|---|---|
| 2825389 | 12/1978 | Fed. Rep. of Germany | 355/3 SH |

*Primary Examiner*—Bruce H. Stoner, Jr.
*Attorney, Agent, or Firm*—Kenway & Jenney

[57] ABSTRACT

A sheet stripping assembly has a sheet removal blade moveable between a first position overlying a marginal portion of a photosensitive member of a copying apparatus and a second position in which it does not overlay the photosensitive surface marginal portion. Trip elements mounted on a moving platen control movement of the blade through a blade moving mechanism. At the end of a copy cycle, the blade is left in the second position.

6 Claims, 7 Drawing Figures

SHEET REMOVAL ASSEMBLY

BACKGROUND OF THE INVENTION

This invention relates generally to photocopying apparatus and in particular to apparatus for removing sheets from the photosensitive surface of a photocopying apparatus.

U.S. application Ser. No. 055,523, filed July 9, 1979, describes apparatus for removing sheet material from the photosensitive surface of a photocopier in which a leading corner edge of the sheet is directed toward output rollers or wheels which catch the corner and pull the remainder of the sheet through to the exit station. After the corner edge is engaged by the wheels or rollers, the portion of the sheet removal system overlying the drum is shifted away from the drum and transfer of the developed image from the photosensitive surface to the transfer sheet can take place over the full width of the surface. That apparatus thereby advantageously provides, in a liquid transfer development system, a full width image transfer over substantially the entire length of a transfer sheet.

It is a principal object of this invention to provide a novel sheet removal mechanism operating in accordance with the principles described in application Ser. No. 055,523 and which is reliable, simple in operation, low in cost, and which has a "snap-on" capability. Other objects of the invention are a sheet removal mechanism which minimizes the likelihood of damage to the photosensitive surface and which allows full width copying from the photosensitive surface to a transfer material.

SUMMARY OF THE INVENTION

The invention relates to a photocopying apparatus having a moveable photosensitive member, a charging element, an assembly for scanning an original document thereby exposing the photosensitive member to a pattern of light energy to selectively discharge portions of the photosensitive member to form a latent image, a development assembly for developing the electrostatic image to form a developed image, a transfer assembly for transferring the developed image to a transfer material which is brought into contact with the photosensitive member, a removal device for removing the transfer material from contact with the photosensitive member, and a cleaning station for cleaning the photosensitive member in preparation for next copy cycle.

The invention features a removal device having a first and a second mechanical trip element, each of which moves in a timed relation to the movement of the transfer material, and a sheet removal mechanism for providing full width transfer from the photosensitive surface to the transfer material, and in particular, to substantially the entire edge portion of the transfer material.

The sheet removal mechanism features a sheet removal blade, an assembly for moving the blade between a first position in which the blade overlays a marginal portion of the photosensitive member and a second position in which the blade is moved from its overlying position with respect to the photosensitive member. The moving assembly is responsive to the trip elements so that after a copy cycle is completed the blade member is positioned in its second position. The trip elements are positioned for moving the blade to and from the first position during a copy cycle for preventing a leading edge corner of the transfer material from contacting the photosensitive member, and the blade, in its first position, guides the corner of the sheet material away from the photosensitive member to a transport mechanism.

DESCRIPTION OF THE DRAWINGS

Other objects, features, and advantages of the invention will be apparent from the following description of a preferred embodiment taken together with the drawings in which.

DESCRIPTION OF THE PREFERRED EMBODIMENT

Figure 1:
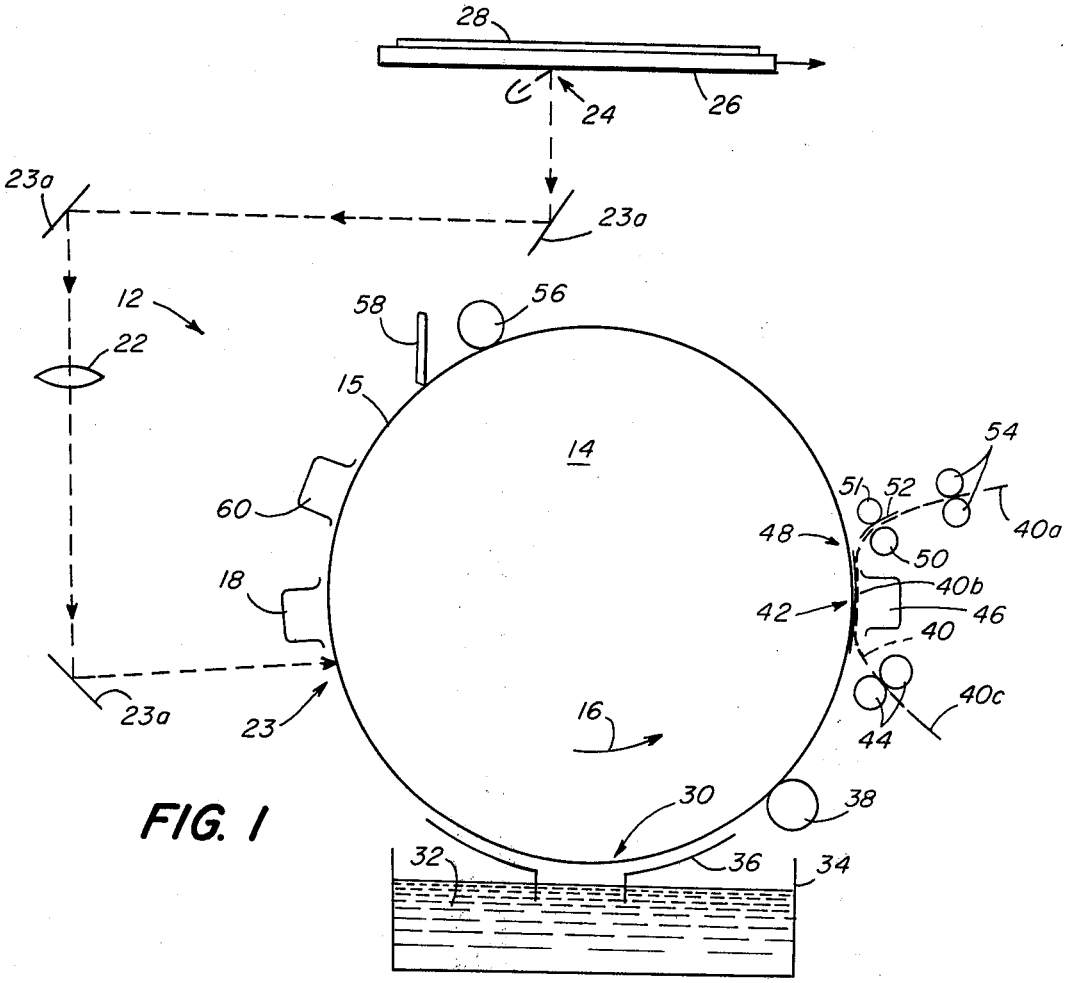
FIG. 1 is a rear schematic elevation view of a typical liquid toner copying apparatus in which the invention can be employed.

Referring to FIG. 1, a photocopier 12, in which the present invention can be employed, has a photosensitive drum 14, having a photosensitive surface 15, preferably a selenium layer deposited on an aluminum substrate, rotating in the counterclockwise direction as indicated by the arrow 16. A charge corona 18 charges the drum surface 15 to about 30 1000 volts D.C. The charged surface 15 is exposed to an image transmitted to the drum through a lens 22 at an exposure station 23. In the illustrated embodiment the lens 22 receives the image through an arrangement of mirrors 23*a*, from a scanning station 24 through which a moving platen 26 holding an original document 28 moves.

The image is focused on the drum photosensitive surface 15 and thereupon the charge on the drum surface forms an electrostatic latent image comprising a pattern of electrical charges. The electrostatic latent image on the drum surface is brought to a development station 30 where a liquid developer 32 having, in the illustrated embodiment, a negatively charged toner, contacts the electrostatic image to develop the image. The development station 30 includes a developer tank 34 and a development electrode 36. Developer 32 is introduced between the development electrode and the drum surface 15 to develop the electrostatic image. The drum surface 15, now wetted and carrying the developed image, travels past a metering roll 38 which controls and limits the thickness of the liquid developer on the drum surface.

A copy material, which is preferably a sheet 40, is fed to the drum surface 15 at a transfer station 42. The sheet 40 is conveyed to the surface by sheet registration rollers 44. There, the sheet contacts the drum surface. A positive charge from a transfer corona 46 is applied to the back of the copy material sheet 40, causing the transfer of the negatively charged toner particles from the developed image on the drum surface 15 to the copy sheet 40. The sheet 40 is stripped off the drum surface by a pick-off assembly 48 that directs the copy sheet 40 to a feed-away roller 50, a knurled roller 51, and a paper guide 52. The sheet is fed along a path to other rollers 54 that transport the sheet to an exterior receiving tray at an exit station (not shown) of the photocopier 12.

After transfer, there remains on the drum surface 15 a residue of liquid developer that is removed by a surface contacting cleaning roller 56 and a cleaning blade 58. Finally, the drum surface is electrically neutralized prior to the next charging step by a high voltage A.C. neutralizing charge from a discharge corona 60.

When the sheet 40 of transfer material, usually paper, is brought to the transfer station 42, the sheet contacts the drum surface 15 in successive portions. Referring to FIG. 1, for example, it can be seen that a leading portion 40*a* of the sheet is between rollers 54 for transport away from the drum surface. An intermediate portion 40*b* of the sheet is in contact with the drum surface 15 at the transfer station 42, where image transfer occurs. A trailing portion 40*c* of the sheet is being conveyed to the transfer station 42.

Figure 3:
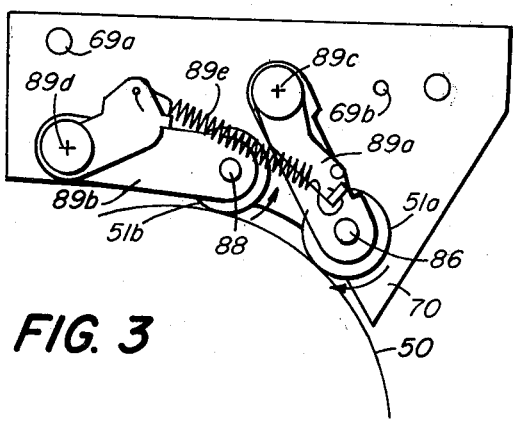
FIG. 3 is an elevation view of the transport mechanism from the blade side of the transport mechansim base plate.
Figure 4:
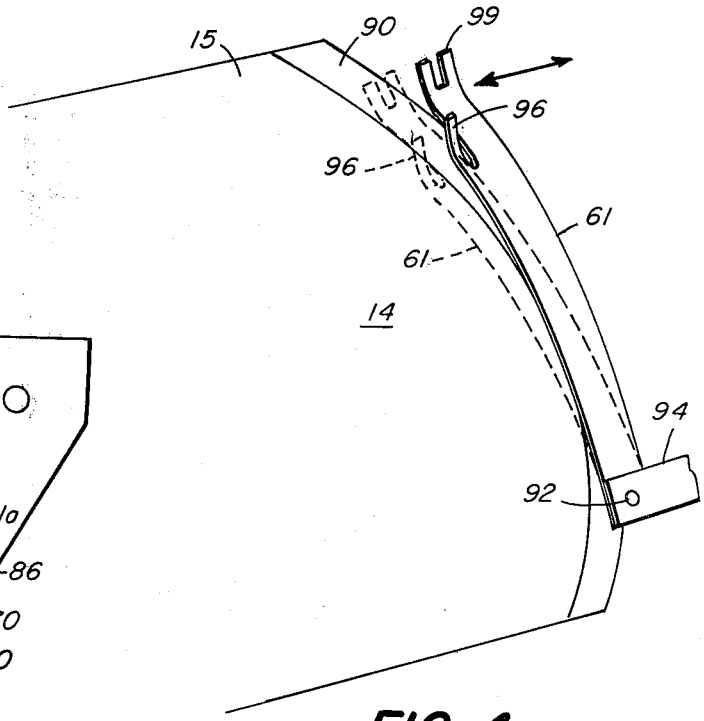
FIG. 4 is a top perspective view of the blade portion of the preferred embodiment of the invention in juxtaposition opposite a photosensitive drum surface.
Figure 2:
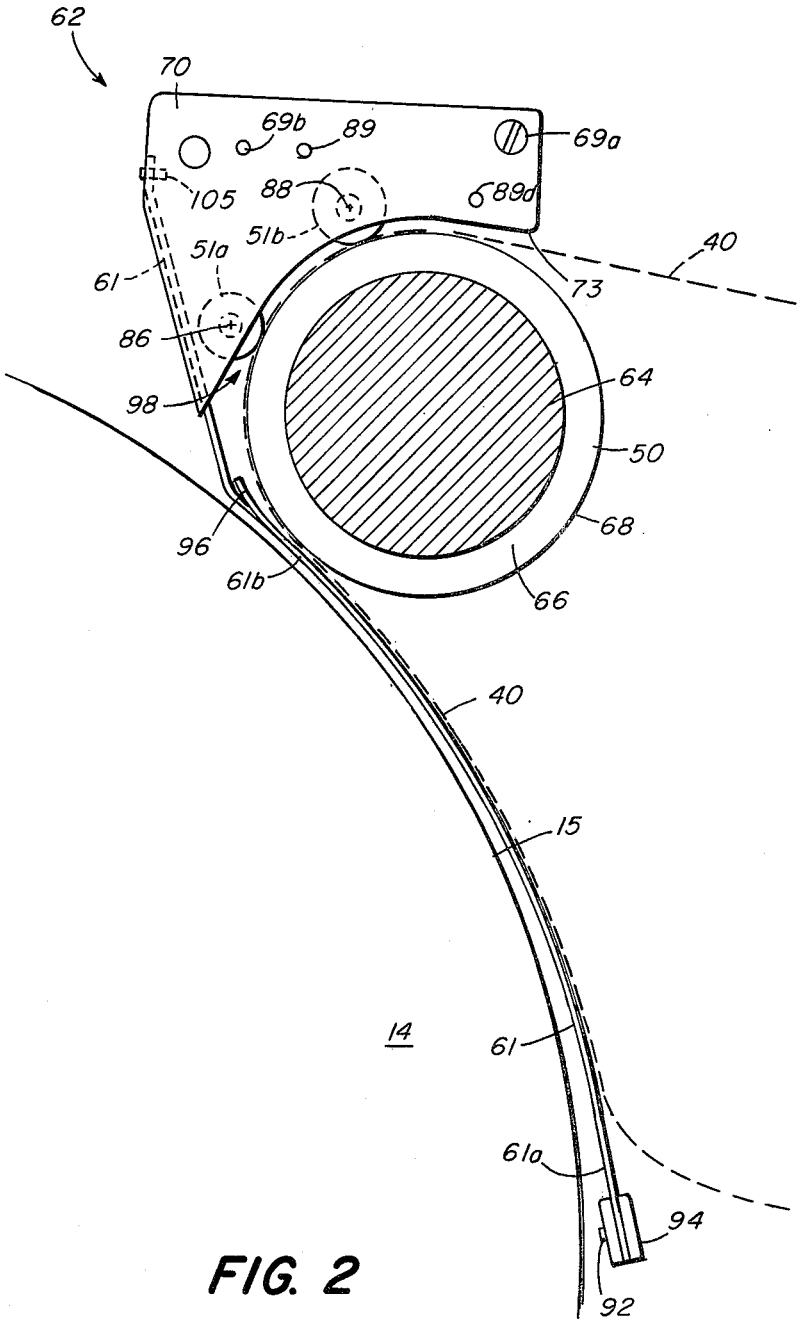
FIG. 2 is a cross-sectional elevation view of the transport mechanism portion of the preferred embodiment of the invention in juxtaposition to a photosensitive drum surface.

Referring to FIGS. 2, 3, and 4, the pickoff assembly 48 has a sheet removal pickoff blade 61, and just above the pick-off blade, a sheet transport assembly or mechanism 62 that includes the feed-away roller 50, lower and upper knurled rollers 51*a*, 51*b* and the paper guide 52 of FIG. 1. The feed-away roller 50 is mounted for rotation on a shaft 64 and shaft 64 is positionally fixed adjacent the drum by the paper handling portion of the photocopier frame. The roller preferably has a metal body 66 with a surface layer 68 of rubber.

The illustrated sheet transport assembly 62, with the exception of roller 50, is supported adjacent the roller 50 by attachment to the remainder of the pickoff assembly by a screw/spacer 69*a* and a pin 69*b*, and includes a vertically oriented base plate 70 having a lower edge 73 shaped to conform to a portion of the circumference of the feed-away roller 50 so that a paper sheet 40 carried around the roller is guided by the edge. The base plate 70 is secured to a support plate 74 (FIG. 5) mounted on the photocopier frame by a locking latch 78 (FIG. 6) pivotally mounted on the frame to engage a groove in a member 79 (FIG. 6) to lock the entire sheet removal mechanism into position. (A second grooved member 80 fits into a slotted lock member on the photocopier frame.)

The transport assembly lower knurled wheel 51*a* and upper knurled wheel 51*b* are secured to and mounted for free rotation on shafts 86, 88 respectively. Shafts 86, 88 project toward the base plate 70 from pivoting lug members 89*a*, 89*b* (FIG. 3) secured to plate 70 at pivot axes 89*c*, 89*d*, respectively. A spring 89*e*, connected to lugs 89*a* and 89*b*, urges or biases the knurled wheels 51*a*, 51*b* toward roller 50. The knurled wheels 51*a*, 51*b* thus ride on the feed-away roller 50 to grip and transport the image carrying "wet" side of sheets 40 around the roller 50.

The illustrated drum photosensitive surface layer 15 extends over an aluminum substrate 90 (FIG. 4). Typically an edge of the substrate 90 is not covered by the photosensitive layer. The pick-off blade 61 is located below the transport assembly 62 adjacent a marginal edge of the drum photosensitive surface 15, as shown in FIG. 4. The blade 61 is curved and conforms generally to the circumference of the drum 14. The illustrated blade is pivotally mounted at its lower end 61*a* by a threaded screw member 92 extending through a bifurcated bracket 94 secured to the support plate 74 (FIG. 5) and the blade is movable between the positions shown in FIG. 4 by the dotted and solid line representations of the blade 61. Preferably, the blade is spaced from the drum surface 15 so that its movement will not create wear on the surface.

In a first position of the blade 61, which is shown by the dotted representation in FIG. 4, the blade 61 partially overlays the marginal edge of the photosensitive surface 15 of the drum. With the blade 61 in that position, if a sheet 40 is directed to the drum 14 by the sheet registration rolls 44, a side edge of the sheet 40 will slide along the blade, rather than contact the photosensitive surface 15 of the rotating drum 14. The upper end 61*b* of the blade has a tang 96 projecting toward the sheet transport assembly 62, particularly to the nip 98 formed between the feedaway roller 50 and the lower knurled wheel 51*a*, so that the leading edge 40*a* of a sheet 40 sliding along the blade 61 is engaged by the roller 50 and wheel 51*a* of the assembly.

Figure 5:
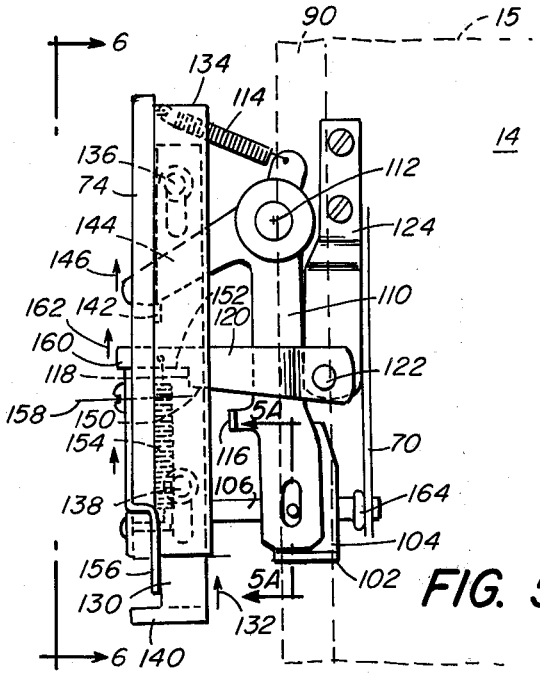
FIG. 5 is a top plan view of the blade moving portion of the sheet removal mechanism according to a preferred embodiment of the invention after the blade has been moved to its position overlaying the photosensitive drum surface.
Figure 5A:
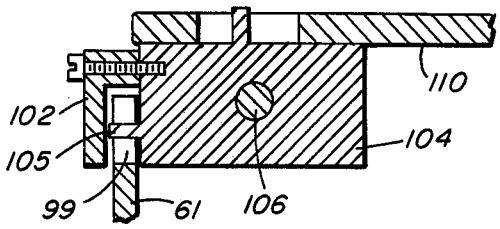
FIG. 5A is a sectional view, along the lines 5A—5A of FIG. 5, showing the connection between the top of the blade and the blade moving portion of the sheet removal mechanism.

Referring to FIG. 5 and FIG. 5A, the upper end 61*b* of the blade includes a bifurcated portion 99 which is captured between an angle member 102 and a laterally moveable support block 104 of the blade moving portion of the sheet removal assembly. (In FIG. 5, the transport mechanism has been omitted for clarity.) The bifurcated portion 99 is captured by a pin 105 (schematically shown in FIG. 2) which passes into the angle member 102 from laterally movable block 104. Angle member 102 is secured at its upper end to the block 104. Block 104 slides laterally on a pin 106 which is seated between plate 70 and plate 74.

The position of block 104 and hence the upper "captured" portion of blade 61 is fixed by a pivoting lateral control plate member 110 which is mounted above block 104 and which pivots about a pivot axis 112. Plate 110 is urged in a counter-clockwise direction about pivot axis 112 by the action of a tension spring 114. Plate member 110 further has an upwardly bent protrusion 116 which enables it to engage and lock against a shoulder portion 118 of a pivoting plate member 120. Plate member 120 generally lies in a plane vertically above the plane of member 110 and pivots about a pivot axis 122. Member 120 is supported at pivot axis 122 by a support member 124 mounted on a flange portion of plate 70.

Member 110 is rotated in the clockwise direction by the movement of a metal strip member 130 in the direction of an arrow 132. Strip member 130 is supported by a horizontally directed support member 134 supported by plate 74 and is guided by support pins 136, 138 for movement substantially parallel to plate 74. Strip member 130 has a vertically downturned portion 140 and a vertically downwardly directed actuating protrusion 142. Protrusion 142 is orientated substantially parallel to plate 74, and is in interferring contact with an arm 144 of member 110. As strip member 130 moves in the direction of arrow 132, arm 144 moves in the direction of an arrow 146 thereby causing member 110 to rotate clockwise. As member 110 rotates clockwise, upwardly directed protrusion or member 116 pushes against an edge 150 of member 120 causing member 120 to rotate in a clockwise direction about pivot 122. Continued clockwise rotation of member 110 causes upwardly directed member 116 to slide past the edge 150 of member 120 and to engage a second edge 152 of member 120. After member 110 then reaches the limit of its clockwise rotation, the release of member 130, which is biased in a direction opposite to the direction of arrow 132 by the force of arm 144 upon downward protrusion 142, allows upwardly bent protrusion 116 to be captured by shoulder 118 of member 120 and prevents member 110 from returning from its original starting position. Member 120 thus "captures" member 110 and holds member 110 in a clockwise "inoperative" position. To insure positive "capturing" of member 110, member 120 is pivotally biased in the counterclockwise direction by a spring 154. In this captured condition, the blade member 61 has been pivoted away from its position in which it overlaid a marginal portion of the photosensitive surface 15 so that successive portions of the sheet 40 can be brought into contact with the photosensitive drum surface and will contact the photosensitive surface fully from one side edge of the sheet to the other.

Member 110 can be released from its "captured" position by the clockwise movement of member 120 to a position wherein shoulder 118 no longer acts to block the return counterclockwise movement of member 110. A pivoting release plate member 156, which is mounted on the support plate 74 to pivot about a pivot axis 158 moves in a clockwise direction (looking from the left hand portion of FIG. 5) and causes an arm 160 of member 120 to move in the direction of arrow 162. Thereby, member 120 releases member 110 and member 110 then pivots in a counterclockwise direction, under the influence of spring 114, and pushes rearwardly on pin 105 (FIGS. 5 and 5A) and thus pushes block 104 along with the end 99 of blade 61, rearwardly until block 104 comes to a position in contact with washer member 164. In this position, the blade member 61 overlays a marginal portion of the photosensitive drum surface for directing a sheet material toward the roller 50 and wheel 51*a* nip.

Figure 6:
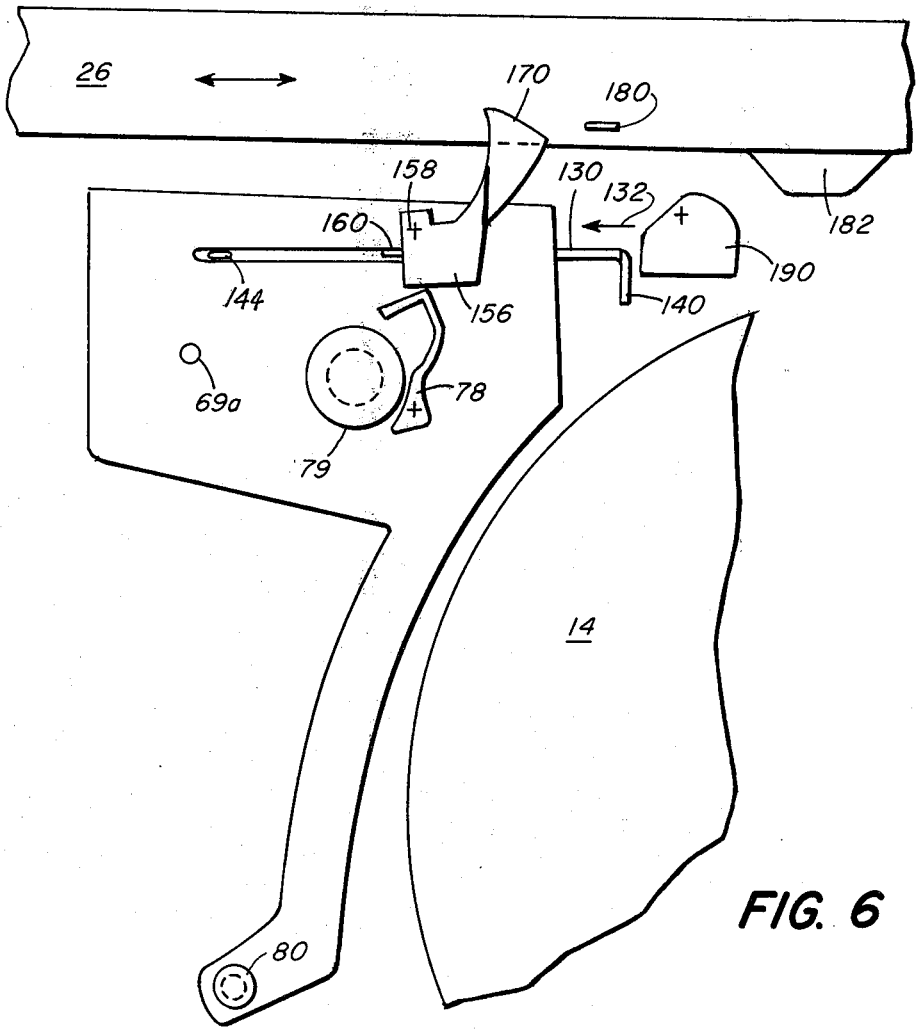
FIG. 6 is a front elevation view taken from lines 6—6 of FIG. 5 with, however, the elements shown before the blade has been moved to its overlaying position.

The operation of the sheet removal mechanism is controlled in the illustrated embodiment, by trip elements 180, 182 mounted on the moving document platen 26. Trip element 180 is mounted on platen 26 for pivotal movement about a vertical axis only in the direction of motion corresponding to reverse movement of the platen. Referring now to FIG. 6, one trip element 182 acts to move downwardly directed member 140 in the direction of arrow 132 (to the left in FIG. 6), thereby moving the blade member to a position in which it does not overlay the photosensitive surface of the drum. The second trip element 180 acts to depress the actuating portion 170 of plate member 156 to release the upturned portion 116 from its captured position adjacent shoulder 118 of 120.

Still referring to FIG. 6, the trip elements 180, 182 are mounted on the document platen 26 so that at the end of a copy cycle the blade 61 does not overlay the marginal portion of the photosensitive surface 15. In particular, when a copy cycle begins, the first trip member 180, which is horizontally directed from the document platen 26, cannot pivot and forces member 156 downward in a clockwise pivoting motion and thus allows the blade to move laterally to a position in which is overlays the photosensitive surface of the drum. Thereafter, and in timed relation to the movement of the transfer medium, the second trip element 182 activates a cam member 190 pivotally mounted on the fixed frame of the photocopier which directs member 140 of slide 130 in the direction of arrow 132 whereby arm 160 is pushed leftward and (now referring to FIG. 5) member 110 rotates in a clockwise manner and portion 116 is again captured by shoulder 118 of member 120. Thus, the blade is moved in timed relation to the movement of the transfer sheet away from the marginal portion of the drum photosensitive surface and is locked in this position by the blade movement mechanism.

Upon the return (rightward movement in FIG. 6) of the document platen to its starting position, the first trip element 180, when it encounters the upper actuating portion of element 156, simply pivots out of the way in the horizontal plane, and does not cause further movement or rotation of element 156. The second trip element 182 again actuates cam member 190, however since the mechanism is already in its "captured" position, no further movement of the blade results. Thus, at the end of the copying cycle, the blade is left in a position in which it does not overlay the marginal portion of the photosensitive surface.

SUMMARY OF THE MAJOR ADVANTAGES AND UNOBVIOUSNESS OF THE INVENTION

The sheet removal mechanism described herein advantageously provides sheet removal in a liquid developer system which allows substantially full width transfer from the photosensitive surface to the transfer medium. In addition, the sheet removal apparatus minimizes the likelihood of damage to the photosensitive medium by minimizing the time during which the sheet removing blade overlays the photosensitive medium.

The invention herein further provides a compact mechanism which is operated, in the illustrative embodiment, from a moving platen. The mechanism advantageously makes use of trip release elements to effectively and accurately translate the sheet stripping member into and out of its overlay position with respect to the photosensitive surface. Thus, unlike the specific mechanisms described in U.S. application Ser. No. 055,523, noted above, the mechanism herein has a rest position in which it does not overlay the photosensitive member and it is mechanically operated by a moving document platen and not the scanning mirror elements of the optical system.

Additions, subtractions, deletions, and other modifications of the described preferred embodiment will be apparent to one practiced in the art and are within the scope following claims.

What is claimed is:

1. In a photocopying apparatus having
a moveable photosensitive member,
means for charging the photosensitive member,
means for scanning an original document and exposing said photosensitive member to a pattern of radiant energy,
whereby said photosensitive member is selectively discharged by said radiant energy to form a latent image,
means for developing said latent image to form a developed image,
means for transferring said developed image to a transfer material brought into contact with said photosensitive member, means for removing said transfer material from contact with said photosensitive member, and means for cleaning said photosensitive member in preparation for a next copy cycle, the improvement wherein said removing means comprises a first and a second mechanical trip element which move in a timed relation to the movement of said transfer material, a sheet removal mechanism having a sheet removal blade, means for moving said blade between a first position in which said blade overlays a marginal portion of said photosensitive member for engaging a corner of a leading edge of said sheet conveyed to said transfer station, preventing said corner from contacting said photosensitive surface, and a second position in which said blade is removed from its overlying position with respect to said photosensitive member whereby said sheet can, at said transfer station, contact said surface at said marginal portion, said moving means being responsive to said trip elements after a copy cycle is completed for maintaining said blade member in said second position, means for mounting said trip elements for moving said blade to and from said first position for preventing a leading edge corner of said transfer material from contacting said photosensitive member, and said blade in said first position, guiding material away from said photosensitive member to a transport mechanism, whereby full width transfer from the photosensitive member to the transfer material takes place over substantially all of the edge portion of the transfer material.

2. The apparatus of claim 1 wherein said scanning means comprises a moving platen for holding an original and for translating said original along a scan path, and said mounting means comprises means for mounting said trip elements on said platen for providing said timed relation.

3. The apparatus of claim 2 wherein said sheet removal mechanism comprises at least one spring biased knurled roller, a driven roller forming a nip with said knurled roller, said nip being positioned in juxtaposition to an upturned end of said blade, and said knurled roller being resiliantly biased toward said driven roller, whereby said knurled roller and said driven roller engage a leading edge corner of said transfer material for guiding said material away from said photosensitive member to an exit station.

4. In a photocopying apparatus having a moveable photosensitive member, means for charging the photosensitive member, means for scanning an original document comprising a moving platen for holding an original and for translating said original along a scan path and exposing said photosensitive member to a pattern of light energy, whereby said photosensitive member is selectively discharged by said light energy to form a latent image, means for developing said latent image to form a developed image, means for transferring said developed image to a transfer material brought into contact with said photosensitive member, means for removing said transfer material from contact with said photosensitive member, and means for cleaning said photosensitive member in preparation for a next copy cycle, the improvement wherein said removing means comprises a first and a second mechanical trip element which move in a timed relation to the movement of said transfer material, a sheet removal mechanism having a sheet removal blade, means for moving said blade between a first position in which said blade overlays a marginal portion of said photosensitive member, and a second position in which said blade is removed from its overlying position with respect to said photosensitive member, said moving means being responsive to said trip elements after a copy cycle is completed for maintaining said blade member in said second position, means for mounting said trip elements on said platen for moving said blade to and from said first position for preventing a leading edge corner of said transfer material from contacting said photosensitive member, and said blade in said first position, guiding material away from said photosensitive member to a transport mechanism, whereby full width transfer from the photosensitive member to the transfer material takes place over substantially all of the edge portion of the transfer material, said sheet removal mechanism further comprising:

a first pivoting member having a first arm and a second arm, said first arm being adapted to control the position of one end of said blade member and said second arm extending substantially in the plane of movement of said first arm, a second pivoting member positioned in an interferring relationship with at least a portion of said first pivoting member whereby said second pivoting member obstructs free movement of said first pivoting member, a first actuating member for causing rotation of said first pivoting member to a position past said interference with said second pivoting member, a second actuating member for causing pivoting rotation of said second pivoting member for removing said interference whereby said first pivoting member has substantially free rotational movement, said first and second actuating members being respectively actuated by the first and second trip elements, whereby upon movement of said first actuating member said first pivoting member is captured by said second pivoting member and wherein actuating movement of said second member affects rotation of said second pivoting member to release said first pivoting member from its captured condition.

5. The apparatus of claim 4 further comprising means for biasing said first pivoting member away from said captured position and for biasing said second pivoting member away from said actuating release movement.

6. The apparatus of claim 1 wherein said mechanism has means for releasably connecting the entire mechanism into and out of an operative position adjacent the photosensitive member.

* * * * *